US005989797A

United States Patent [19]

Vandenabeele

[11] Patent Number: 5,989,797

[45] Date of Patent: Nov. 23, 1999

[54] LIGHT-SENSITIVE SILVER HALIDE PHOTOGRAPHIC MATERIALS COMPRISING ZEOLITES

[75] Inventor: Hubert Vandenabeele, Mortsel, Belgium

[73] Assignee: Agfa-Gevaert, N.V., Mortsel, Belgium

[21] Appl. No.: 09/167,725

[22] Filed: Oct. 7, 1998

Related U.S. Application Data

[60] Provisional application No. 60/070,390, Jan. 5, 1998.

[51] Int. Cl.[6] ..... G03C 1/09; G03C 1/015; G03C 1/025

[52] U.S. Cl. ..... 430/539; 430/523; 430/569; 430/564; 430/603; 430/604; 430/605; 430/608

[58] Field of Search ..... 430/569, 603, 430/604, 608, 605, 564, 523, 539

[56] References Cited

U.S. PATENT DOCUMENTS

| | | | |
|---|---|---|---|
| 4,845,023 | 7/1989 | Mifune | 430/569 |
| 5,447,834 | 9/1995 | Fujita et al. | 430/559 |

FOREIGN PATENT DOCUMENTS

| | | |
|---|---|---|
| 0 644 454 | 3/1995 | European Pat. Off. . |
| 0 644 455 | 3/1995 | European Pat. Off. . |
| 2 119 946 | 11/1983 | United Kingdom . |

*Primary Examiner*—Richard L. Schilling
*Attorney, Agent, or Firm*—Breiner & Breiner

[57] ABSTRACT

A light-sensitive silver halide photographic material and a method for preparing said material is provided, wherein said material comprises a support and on one or both sides thereof at least one silver halide emulsion layer and a protective antistress layer as an outermost layer, characterized in that said silver halide emulsion layer(s) and/or said protective antistress layer comprise(s) at least one zeolite loaded with a photographically useful group. Said photographically useful group is a soluble salt, an organic compound releasing chloride, bromide or iodide, a sulfur salt, a selenium salt, a tellurium salt and/or a metal salt of group VIII.

Further a method of preparing said light-sensitive silver halide photographic material as described hereinbefore is provided, said method comprising the steps of precipitating silver halide crystals in a colloidally stable aqueous medium by mixing an aqueous silver salt solution and at least one halide solution thereby forming an emulsion; flocculating, followed by decanting, washing and redispersing said emulsion or washing said emulsion by dialysis or ultrafiltration followed by adding one or more colloidally stable solution(s); chemically ripening said silver halide crystals in said emulsion, adding thereto solutions comprising chemical ripening agents; adding coating solutions comprising coating additives, followed by coating and drying, wherein in at least one of said steps at least one zeolite is added to the said medium, solution or emulsion.

10 Claims, No Drawings

LIGHT-SENSITIVE SILVER HALIDE PHOTOGRAPHIC MATERIALS COMPRISING ZEOLITES

This application claims benefit of U.S. Provisional Application No. 60,070,390 filed Jan. 5, 1998.

FIELD OF THE INVENTION

The present invention relates to a rapidly processable light-sensitive silver halide light-sensitive photographic material. Moreover a method of preparing said material has been described.

BACKGROUND OF THE INVENTION

As is well known in the field of radiography, there is a general trend to enhance the speed of processing. Therefore interest has been directed to rapid access of radiographs, being vital in diagnosis. By the manufacturing of films suitable for rapid processing applications an ideal balance should be sought between the thickness of the coated hydrophilic layers and the obtained sensitivity within a short processing time. Sufficiently thin hardened coatings are required in order to limit the water absorption and in order to reduce the drying time. Rapid processing conditions that can alternatively be applied are development processing at higher pH and higher temperatures of e.g. 30 to 40° C., in order to accelerate the said processing.

However thin coated layers as well as high temperature processing or processing in a developer medium having a higher pH bring about deterioration of the photographic images obtained in that it frequently occurs that fogging of the photographic materials occurs, not only for the freshly prepared materials but to a still larger extent for preserved materials, the more the preservation temperature and/or preservation humidity is higher.

OBJECTS OF THE INVENTION

Therefore it is the main object of the present invention to provide a photographic material that is less dependent on preservation conditions with respect to fog formation, even at high speed processing cycles in automatic processors for materials coated with thin hydrophilic layers.

Other objects will become apparent from the description hereinafter.

SUMMARY OF THE INVENTION

The above mentioned objects are realized by providing a light-sensitive silver halide photographic material comprising a support and on one or both sides thereof at least one silver halide emulsion layer and a protective antistress layer as an outermost layer, characterized in that said silver halide emulsion layer(s) and/or said protective antistress layer comprise(s) at least one zeolite loaded with a photographically useful group.

Further a method of preparing said light-sensitive silver halide photographic material described hereinbefore is provided, said method comprising the steps of precipitating silver halide crystals in a colloidally stable aqueous medium by mixing of an aqueous silver salt solution and at least one halide solution, thereby forming an emulsion;

flocculating, followed by decanting, washing and redispersing said emulsion or washing it by dialysis or ultrafiltration followed by further adding one or more colloidally stable solution;

chemically ripening said silver halide crystals, adding thereto solutions comprising chemical ripening agents;

adding coating solutions comprising coating additives, followed by coating and drying, wherein in at least one of said steps at least one zeolite is present as an additive to the said medium, solution or emulsion.

DETAILED DESCRIPTION OF THE INVENTION

Zeolites, first recognized by Cronstedt as a new group of minerals, was discovered in 1756. A first representative of this group was the mineral called "stilbite".

Zeolites are hydrated metal aluminosilicate compounds with well-defined (tetrahedral) crystalline structures. Because zeolite crystals, both natural and synthetic, have a porous structure with connected channels extending through them, they have been employed as molecular sieves for selectively adsorbing molecules on the basis of size, shape and polarity. Natural zeolites are e.g. clinoptilite, chabazite and mordenite. From the 65 types of zeolite that are known nowadays the majority has a synthetic origin. Reactants in zeolite synthesis have been described e.g. in "Hydrothermal Chemistry of Zeolites" by R. M. Barrer FRS, 1982, Academic Press, London New York. Differences in zeolite compositions are related with differing ratios of silica and aluminum, going from indefinite or 1:0 to 1:1, as in a lattice structure it is impossible to have two trivalent aluminum ions in an adjacent position. Substitution of a tetravalent silicium ion by a trivalent aluminum ion brings about the presence of a less positive charge within the lattice structure of zeolite crystals. A deficiency of positive ions should therefore be compensated by the the presence of "neutralizing" positive ions which are not incorporated in the lattice structure. Ion-exchanging properties are thus provided. Otherwise zeolites may have strongly differing properties as a consequence of their strongly differing balance between hydrophobic and hydrophilic properties of their crystal lattice: presence of low amounts of aluminum ions provides hydrophobic water-repelling lattices, whereas higher amounts of trivalent aluminum ions provide water-attracting hydrophilic lattices. Less hydrophilic zeolite lattices therefore act as molecular sieves, adsorbing dedicated molecules in a selective way. The term "molecular sieves" was first introduced by J. W. McBain in 1932 in order to define porous solid materials acting as sieves on molecular scale. Adsorbing properties further depend on the dimensions of the molecules and of the pores of the zeolite sieves. It has e.g. been established that dimensions of zeolite pores are varying in the range from 0.4 to 4 nm.

Zeolites having exchanged cations or showing molecular adsorption should be considered as "loaded zeolites".

In practical applications volumes packed with zeolite crystals have been employed in water and air or gas filtration systems in order to selectively absorb contaminants from a flowing stream of water and/or gas. So e.g. small zeolite crystals have been selected having a size in the range of from 0.2 up to several millimeters. "The Properties and Applications of Zeolites." have been described in "Special Publication No. 33, The Chemical Society, London 1980." p. 294–328. "Innovation in Zeolite Materials Science" has been disclosed in "Studies in Surface Science and Catalysis", Vol. 37, 1988, P. J. Grobet, W. J.Mortier, E. F. Vansant and G. Schulz-Ekloff, Edited by Elsevier Amsterdam-Oxford-New York-Tokyo.

Especially in photographic materials, the presence of zeolites is unusual. Unexpectedly it has been found that its presence as a releasing agent for photographically useful compounds or for photographically useful precursor compounds is very suitable, wherein its release of the previously added zeolite loaded with aqueous soluble salts of the said compounds makes synthesis and/or addition of the said compounds for silver halide photographic materials possible.

Zeolites provided as finely divided powders are easily loaded by addition of the said powder to aqueous solutions of e.g. group VIII metal ions as iron, cobalt, ruthenium, rhodium, palladium, osmium, iridium, platinum and gold ions.

In this way it is possible to add the said loaded zeolites to a reaction vessel wherein aqueous solutions of soluble silver salts and halide salts are mixed, in order to precipitate silver halide crystals in an aqueous medium, colloidally stabilized by a suitable hydrophilic colloid as e.g. the most frequently used gelatin or derivatives or, in the alternative colloidal silica sol, starch, polyvinyl pyrrolidone etc.. By the addition of zeolites loaded with group VIII metal ions, it is possible to release these metal ions, present as a complex metal ion surrounded with suitable ligands, as a function of pH and ion strength, in order to incorporate them as a dopant in the silver halide crystals. Depending on the time of addition, directly to the reaction vessel or indirectly via silver salt or halide salt solutions, the said dopant or dopants are homogeneously or heterogeneously incorporated over the whole crystal volume of the silver halide crystals formed. Heterogeneous incorporation in the inner part or the outermost part of the formed crystal, called core and shell respectively, is possible. Normally in core-shell layered silver halide crystals, different layers have a different halide composition, but it is also possible that heterogeneity is only caused by the presence of metal ions in the different layers of the silver halide crystals. The said metal ions, whether or not present as complex ions, can be the same or different in different layers of a multilayered silver halide crystal present. Concentrations in different layers of the said crystals present as laminae in multilayer form, may be the same or different, and may have a design, performed in order to direct electron trapping properties of the silver halide crystals at the surface or in the vicinity thereof. If gradients of metal ion dopants are required in different layers or over the whole volume of a silver halide crystal, the addition technique of zeolites, loaded with metal ion dopants is recommended as release of the said metal ion dopants is performed under perfectly controlled conditions. So this release can be triggered by pH, temperature, ion strenght, addition of competing cations, colloids, etc..

Zeolites are further easily loaded by addition of zeolite powder to protic solutions of iodide, bromide or chloride salts of alkaline earth metals, like ammonium, potassium or sodium iodide, bromide or chloride or to aprotic solutions of e.g. organic compounds releasing chloride, bromide or iodide. In the particular case wherein iodide ions should be incorporated in the silver halide crystal lattice as e.g. in silver bromoiodide, silver chlorobromoiodide, silver bromochloroiodide or silver chloroiodide, wherein the ion present in the highest concentration is written first, it is perfectly possible to controll the addition rate of iodide ions and their location in the silver halide crystals. The same can be performed with bromide and/or chloride ions if incorporated in minor amounts in predetermined sites in the volume or on the surface of e.g. silver chlorobromide or silver chloroiodobromide crystals and in silver bromoiodochloride or silver bromochloride crystals respectively.

Zeolites are moreover easily loaded by addition of zeolite powder to aqueous solutions of salts of sulfur, selenium or tellurium, and in particular to labile salts of those chalcogen elements. This is particularly interesting with respect to applications in the chemical ripening, wherein sulphur, selenium and/or tellurium is(are) released from the loaded zeolites at a controlled reaction rate during the chemical ripening process, depending on addition time, pH, pAg, temperature, etc.. Moreover zeolites loaded with group VIII metal salts, and in particular with gold salts, are very useful in order to create development specks for the silver halide crystals to be developed in rapid processing. Minor amounts of iodide are further provided in the chemical ripening process if required. So it may be advantageous to add zeolites loaded with iodide salts before, during or after the chemical ripening. In a preferred embodiment, zeolites loaded with iodide ions are e.g. added before addition of spectral sensitizers to the unripened, so-called "primitive emulsion" in order to promote adsorption of the said spectral sensitizer or sensitizers at the crystal surface. This is particularly useful when silver halide tabular grains are chemically and spectrally sensitized, wherein it is a common method to add the spectral sensitizer(s) before, during or after, but in a more preferred embodiment, before starting chemical ripening. Zeolites loaded with iodide ions can be used as an alternative for the addition of ultrafine silver iodide crystals, added as Lippmann or so-called micrate emulsions. In order to suppress pressure phenomena on the silver halide crystals it may be useful to add still more iodide to the silver halide emulsions. It is known e.g. by everyone skilled in the art that it is favorable to add iodide ions in a later stage of the crystal growth process in the preparation of silver halide crystals in order to suppress pressure phenomena. According to the present invention addition of zeolites loaded with iodide ions during or after chemical ripening, or to the coating solutions before coating is recommended in order to reduce the said pressure phenomena. This effect should be considered as particularly favorable with respect to rapid processing applications of exposed silver halide photographic materials coated with thin vulnerable loaded colloidal layers.

Addition of zeolites loaded with aqueous soluble palladium salts is another application, wherein said zeolites are favorably added to coating solutions before coating, followed by drying. In favor of preservation properties addition of zeolites loaded with gold salts is further recommended, wherein said addition can proceed in the chemical ripening and/or in the preparation step of the coating solutions.

Further zeolites loaded with photographically useful precursor compounds are very useful in that their release from the loaded zeolites makes in situ synthesis of suitable compounds possible. In a preferred embodiment ultramicrocrystalline silver halide grains are prepared "in situ" by addition of zeolites loaded with aqueous soluble silver salts and zeolites loaded with aqueous soluble halide salts. Release of silver ions and halide ions leads to the generation "in situ" of the said ultramicrocrystalline silver halide. If in addition stable silver halide crystals are present in the reaction vessel said ultramicrocrystalline silver halides are deposited on the coarser grains, wherein the driving force is the physical ripening or so-called Ostwald ripening. In that way deposition of limited amounts of e.g. fine silver iodide grains (however being not limited thereto) on host grains is possible, whether in form of a "closed" layer, in form of separate isles, uniformly distributed on e.g. main parallel {111}- or {100}-planes of the corresponding tabular grains, whether in form of protrusions or epitaxial depositions. An improved spectral sensitization can be expected in that case in that a better adsorption of spectral sensitizers is observed and/or in that lower amounts of spectral sensitizer(s) are required in order to get the best fog to speed relationship. If lower amounts of spectral sensitizers are required this is particularly in favor of providing less residual color, also called "stain", especially after rapid processing.

It is further very advantageous that the release of ions from zeolites loaded with aqueous soluble salts is stopped once the coating solutions are coated and dried in order to form light-sensitive or light-insensitive layers of a silver halide photographic material. The fact that this release is stopped then is particularly in favor of preservability of the prepared materials.

As has already been established hereinbefore an additional advantage of the presence of zeolites, whether or not present as "loaded zeolites" in coated hydrophilic layers of silver halide photographic materials is their ability to reduce pressure sensitivity and thus to reduce the generation of fogging streaks, more particularly when materials coated from very thin coated layers are run in automatic procesing machines in rapid processing cycles, as e.g. processing cycles proceeding within a total processing time of from 20 up to 90 seconds, and more preferably from 30 up to 60 seconds, as in medical radiographic applications.

Although there is no limitation about the layer or layers wherein the said zeolites are present during coating, it is particularly preferred, in order to reduce pressure marks, that the zeolites are present in the light-sensitive silver halide emulsion layer(s).

According to the present invention preferred amounts in the silver halide emulsion layer(s) and/or protective antistress layer of a silver halide photographic material are in an amount of from 1 to 200 mg/m$^2$ and more preferably in an amount of from 10 to 100 mg/m$^2$.

In materials suitable for rapid processing applications it is further recommended that a material according to the present invention is overcoated with one or more protective antistress layer or layers wherein said antistress layer(s) comprise(s) a total amount of gelatin of less than 1.2 g/m$^2$.

Although there is no limitation with respect to the choice of silver halide photographic materials according to the present invention in which the said zeolites are present, in a preferred embodiment said material is a radiographic material, more preferably a medical X-ray material.

Within the scope of the present invention materials such as (medical and industrial) X-ray film materials, presensitized plates, graphic art films and paper, offset plates, etc., may comprise (loaded or unloaded) zeolites, without however being limited thereto.

Preferably an X-ray film material, and, in particular, any film for medical diagnostic imaging may comprise said zeolites, wherein said film may be exposed with a laser directed by digitized data obtained after conversion of information captured by suitable means after exposure to radiation of part of the human body as described e.g. in EP-A 0 794 456 or exposed after conversion of X-rays by one or two intensifying light-emitting screen(s) brought into contact with the said film and wherein said film may comprise cubic and/or tabular silver halide crystals as described e.g. in EP-Applications Nos. 97200590 and 97200591, both filed Mar. 1, 1997 and No. 97202169, filed Jul. 11, 1997.

According to a preferred embodiment of the present invention, the said materials are composed of at least one light-sensitive silver halide emulsion layer comprising emulsion crystals comprising tabular {111} or {100} crystals.

Preferably said materials are X-ray materials, wherein the said X-ray materials are single-side or double-side coated materials. It is clear that the total processing time wherein the processing cycle is run after exposure with a suitable exposure source strongly depends on the amounts of silver coated into the light-sensitive silver halide emulsion layers. In a preferred embodiment according to the present invention materials suitable for rapid processing applications following the steps of developing, fixing, rinsing and drying, should be run in a total processing time of from 30 up to 90 seconds. Especially in those circumstances the benifits offered by the present invention become available in the most expressive way.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the claims.

EXAMPLES 1.1. Support and Subbing Layer Composition

A blue tinted, longitudinally stretched polyethylene terephthalate film support having a thickness of approximately 0.61 mm was subbed on both sides with a coating solution at a coverage of 130 m$^2$ per liter. The layer was dried in a hot air stream whereafter the coated support was stretched transversally to 3.5 times its original width, at a temperature of about 110° C. The final thickness of the film was 175 μm. The film was then heat-set while being kept under tension at a temperature of 220° C. for about 10 seconds. After heat setting the film was cooled.

This subbing procedure resulted in the following layer composition per m$^2$ and per side:

- 0.17 g of latex copolymer vinylidene chloride (88 wt %), methylacrylate (10 wt %) and itaconic acid (2 wt %),
- 0.06 g of latex copolymer of methylmethacrylate (47.5 wt %), 1,3-butadiene (47.5 wt %) and itaconic acid (2 wt %),
- 0.001 g polymethylmethacrylate-particles with an average diameter of 3.5 μm as a matting agent,
- 0.003 g Akypo OP 80 (Chemy) and 0.001 g Hostapal BV (Hoechst AG) as coating aids.

A second subbing layer was further coated at a coverage of 30 m$^2$ per liter of coating solution. The coating solution was applied at 40° C. The layer was dried in a hot air stream at 130° C. during 2 minutes, resulting in the following layer composition per m$^2$ and per side:

- 0.19 g of gelatin (Koepff),
- 0.17 g of Kieselsol 100F (Bayer AG),
- 0.001 g of polymethylmethacrylate particles with an average diameter of 2.5 μm as a matting agent,
- 0.007 g of Ultravon W (Ciba Geigy) and 0.003 g of Arkopal N060 (Hoechst AG) as coating aids.

1.2. Preparation of the Coating Solution of the Emulsion Layer 1.2.1. Emulsion Preparation A tabular silver bromoiodide emulsion, containing 1 mole % of AgI and 99 mole % of AgBr based on silver, was precipitated using the double jet technique as described in U.S. Pat. No. 5,595,864. The excess $KNO_3$ was removed by the flocculation and washing technique after precipitation. The thus obtained tabular grain emulsion, containing 42 grams of gelatin per mole of $AgNO_3$, had the following characteristics:

- mean diameter of the circle with the same projective surface of the tabular grain: 1.12+/−0.23 μm (0.23 being standard variation s).

mean thickness of the tabular grains: 0.23 μm.

aspect ratio: 5.5.

percentage of total projective surface covered by the tabular grains: 98%.

1.2.2. Chemical Sensitization

After redispersion whereby the emulsion was containing a total amount of gelatin of 75 g, the emulsion was divided in 4 parts. Coated afterwards in Material No. 1 the correspondingly numbered part 1 was chemically sensitized in the presence of anhydro-5,5'-dichloro-3,3'-bis(n.sulfobutyl)-9-ethyloxacarbocyanine hydroxide in an amount of 0.66 g per mole of silver, chloro auric acid, sodium thiosulphate and potassium thiocyanate in respective amounts (per mole of silver) of 0.35 mg, 1.70 mg and 136 mg in order to get an optimized fog-sensitivity relationship. The pH of the said emulsion was adjusted at 5.15; the pAg at 7.00 at a temperature of 40° C.

Part 2 was chemically ripened with lowered amounts of sodium thiosulphate (50% of the original amount of 1.70 mg), but the dimethylselenoureum compound was added in an amount of 0.92 mg per mole of silver, whereas chloro auric acid was added to the coating solution in an amount increased up to 0.7 mg.

To part 3, chemically ripened as part 2, an extra amount of "unloaded" zeolite was added to the coating solution.

In part 4 a previously prepared zeolite dispersion (ZDDMSe) wherein per mole of silver nitrate 3.4 g of gelatin, 0.76 g of zeolite and 34 g of demineralized water were present together with dimethylselenoureum (in the same amount as in part 3) instead of the dimethylselenoureum compound added in aqueous solution.

Every part was ripened to the point where an "optimized fog-sensitivity relationship" was obtained.

Preparation of Zeolite Dispersions

In order to prepare the zeolite dispersion "ZDDMSe" zeolite from DEGUSSA, Belgium, having an average particle size of 1 μm, was taken in an amount of 2.25 g and added to a gelatinous solution of 10 g of gelatin in 100 ml of demineralized water at a temperature of 38° C. Thereto dimethylselenoureum was added in an amount of 27 ml of a solution 0.01% by weight of dimethylselenoureum in demineralized oxygen-free water and the dispersion was stirred for 10 minutes and left for another 20 minutes. The same procedure can be performed when other compounds are added, as e.g. gold salts. Therefore the same amounts of a solution concentrated 10 times more than the dimethylselenoureum solution is used, in order to add the appropriate amounts of gold as set forth hereinbefore.

It is clear that when "zeolite" as such was added to the emulsion part 3, zeolite in an amount of 2.25 g was added to a gelatinous solution of 10 g of gelatin in 100 ml of demineralized water at a temperature of 38° C. without further "loading" the zeolites from DEGUSSA, Belgium, having an average particle size of 1 μm.

1.2.3. Additional Ingredients of the Emulsion Solution

Per mole of $AgNO_3$ the following ingredients were added to the emulsion at 40° C.: 0.29 g of 4-hydroxy-6-methyl-1,3,3a,7-tetra-azaindene; 9.1 g of sorbitol; 14.5 g of polyethylacrylate (MW=1000000); 3.05 g of 1,3-dihydroxybenzene; 31 g of dextrane (MW=10000); 10 g of gelatin and demineralized water in an amount necessary to get the desired wet coating thickness.

1.3. Preparation of the Coating Solution of the Protective Layer

To 800 ml of demineralized water the following ingredients were added: 44 g of gelatin; 0.92 g of polymethylmethacrylate (average particle diameter: 3.5 μm); 0.3 g of ammoniumperfluorocaprylate; 0.752 g of $C_{17}H_{15}$—CO—NH—($CH_2$—$CH_2$—O—)$_{17}$—H and 4 g of formaldehyde. Demineralized water was added in order to get the desired wet coating thickness and gelatin per $m^2$.

1.4. Coating of the Materials Nos. 1 to 4

Materials 1 to 4 were obtained by coating simultaneously the emulsion layer and the protective layer at both sides of the support making use of the coating solutions for the emulsion and protective layer, held at 38° C., the composition of which has been described hereinbefore, and dried under controlled humidity and temperature conditions, never exceeding a temperature of 30° C. The emulsion and protective layer were coated simultaneously by means of the slide hopper technique with the protective layer on top. Before drying the thicknesses of the emulsion layer and protective layer were 44 and 25 μm respectively. Per $m^2$ and per side the emulsion layer was containing about 3.75 g of silver, expressed as an equivalent amount of silver nitrate and 1.87 g of gelatin. The protective antistress layer was containing 1.1 g of gelatin.

2. Evaluation Procedures 2.1. Exposure Conditions

Samples of the coated materials Nos. 1–4 were preserved for 36 hours at a temperature of 57° C. and at a relative humidity of 34%.

The said samples were exposed with green light of 540 nm during 0.1 seconds using a continuous wedge.

2.1. Processing Conditions

To evaluate the photographic performance, the samples of the materials Nos. 1–4 were processed as follows:

a CURIX HT530 (Agfa-Gevaert trademarked name) processor was used with the following processing time (in seconds) and temperature(in ° C.):

| function: | time | temperature condition |
|---|---|---|
| loading: | 0.2 | |
| developing: | 11.5 | 35° C. (developer described below) |
| cross-over: | 1.7 | |
| rinsing: | 1.1 | |
| cross-over: | 1.8 | |
| fixing: | 8.2 | 35° C. (fixer described below) |
| cross-over: | 2.5 | |
| rinsing: | 5.4 | 20° C. |
| cross-over: | 5.8 | |
| drying: | 8.3 | |
| total: | 46.5 | |

| Composition of Developer: | |
|---|---|
| Composition of the concentrated part: | |
| water: | 200 ml; |
| potassium bromide: | 12 g; |
| potassium sulphite (65% solution): | 249 g; |
| ethylenediaminetetraacetic acid, sodium salt, trihydrate: | 9.6 g; |
| hydroquinone: | 106 g; |
| 5-methylbenzotriazole: | 0.076 g; |
| 1-phenyl-5-mercaptotetrazole: | 0.040 g; |
| sodiumtetraborate (decahydrate): | 70 g; |
| potassium carbonate: | 38 g; |
| potassium hydroxide: | 49 g; |
| diethylene glycol: | 111 g; |
| potassium iodide: | 0.03 g; |
| 4-hydroxymethyl-4-methyl-1-phenyl-3-pyrazolidine-1-one: | 8.15 g; |
| water to make 1 liter. | |

The pH was adjusted to 11.15 at 25° C. with potassium hydroxide. For initiation of the processing one part of the concentrated developer was mixed with 3 parts of water. The pH of this mixture was 10.30 at 25° C.

| Composition of the fixer: | |
|---|---|
| Composition of the concentrated part: | |
| ammonium thiosulfate (78% solution): | 661 g; |
| sodium sulphite: | 54 g; |
| boric acid: | 25 g; |
| sodium acetate-trihydrate: | 70 g; |
| acetic acid: | 40 g |
| water to make 1 liter. | |

The pH was adjusted with acetic acid to 5.30 at 25° C.

To make this fixer ready for use one part of this concentrated part was mixed with 4 parts of water. A pH of 5.25 was measured at 25° C. Following sensitometric characteristics are expressed as set forth hereinafter and are represented in Table 1:

fog levels F, determined as minimum densities above support density, wherein densities are multiplied by a factor of 1000;

speed values S, determined as relative log E values at a density of 1.0 above fog level, wherein said values are multiplied by a factor of 100 (as a lower value is indicative for a higher speed, a negative difference is thus indicative for a speed increase);

gradation levels G, wherein differences are expressed as a procentual figure: G-gradation values are determined between a density of 0.25 and 2.0 above fog level.

TABLE 1

| Mat. No. | Fog | Speed log E | Grad. |
|---|---|---|---|
| 1 (comp. S/Au) | 0.028 | 1.42 | 2.38 |
| 2 (comp. S/Se/Au) | 0.035 | 1.42 | 2.37 |
| 3 (comp. = 2 + Zeol) | 0.026 | 1.42 | 2.39 |
| 4 (inv. = ZDDMSe + S/Au) | 0.036 | 1.37 | 2.33 |

From the Table 1 it can be concluded that addition of zeolites loaded with an aqueous solution of a selenium compound in the chemical ripening step as performed in coating No. 4 leads to a more favorable sensitometry, in that a better speed is attained after preservation of said materials.

Having described in detail preferred embodiments of the current invention, it will now be apparent to those skilled in the art that numerous modifications can be made therein without departing from the scope of the invention as defined in the following claims.

What is claimed is:

1. A light-sensitive silver halide photographic material comprising a support and on one or both sides thereof at least one silver halide emulsion layer and a protective antistress layer as an outermost layer, characterized in that said silver halide emulsion layer(s) and/or said protective antistress layer comprise(s) at least one zeolite loaded with a photographically useful group.

2. Material according to claim 1, wherein said photographically useful group is an aqueous soluble salt.

3. Material according to claim 1, wherein said photographically useful group is an organic compound releasing chloride, bromide or iodide.

4. Material according to claim 1, wherein said photographically useful group is a sulfur salt, a selenium salt, a tellurium salt and/or a metal salt of group VIII.

5. Material according to claim 1, wherein zeolite is present in the silver halide emulsion layer(s) and/or protective antistress layer in an amount of from 1 to 200 mg/m$^2$.

6. Material according to claim 1, wherein zeolite is present in the silver halide emulsion layer(s) and/or protective antistress layer.

7. Material according to claim 6, wherein said zeolite is present in the silver halide emulsion layer(s) and/or protective antistress layer in an amount of from 10 to 100 mg/m$^2$.

8. Material according to claim 1, wherein said antistress layer(s) comprise(s) a total amount of gelatin of less than 1.2 g/m$^2$.

9. A photographic material according to claim 1, wherein said photographic material is a medical X-ray material.

10. Method of preparing a photographic silver halide light-sensitive material according to claim 1, by the steps of precipitating silver halide crystals in a colloidally stable aqueous medium by mixing of an aqueous silver salt solution and at least one halide solution, thereby forming an emulsion;

flocculating, followed by decanting, washing and redispersing said emulsion or washing it by dialysis or ultrafiltration followed by further adding one or more colloidally stable solution;

chemically ripening said silver halide crystals, adding thereto solutions comprising chemical ripening agents;

adding coating solutions comprising coating additives, followed by coating and drying, wherein in at least one of said steps at least one zeolite is present as an additive to the said medium, solution or emulsion.

* * * * *

UNITED STATES PATENT AND TRADEMARK OFFICE

CERTIFICATE OF CORRECTION

PATENT NO. : 5,989,797

DATED : November 23, 1999

INVENTOR(S) : Hubert Vandenabeele

It is certified that error appears in the above-indentified patent and that said Letters Patent is hereby corrected as shown below:

Title page, insert the following:

-- [30] Foreign Application Priority Data
October 15, 1997 [EP] European Pat. Off.
97203216.3 --.

Signed and Sealed this

Twelfth Day of September, 2000

*Attest:*

Q. TODD DICKINSON

*Attesting Officer*

*Director of Patents and Trademarks*